US008186802B2

(12) United States Patent
Sakurai

(10) Patent No.: US 8,186,802 B2
(45) Date of Patent: May 29, 2012

(54) LIQUID EJECTION DEVICES

(75) Inventor: Hisaki Sakurai, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 331 days.

(21) Appl. No.: 12/719,848

(22) Filed: Mar. 8, 2010

(65) Prior Publication Data

US 2010/0238208 A1 Sep. 23, 2010

(30) Foreign Application Priority Data

Mar. 17, 2009 (JP) ..... 2009-064088

(51) Int. Cl.
*B41J 29/393* (2006.01)

(52) U.S. Cl. ..... 347/19; 347/7

(58) Field of Classification Search ..... 347/19, 347/7, 86

See application file for complete search history.

(56) References Cited

U.S. PATENT DOCUMENTS

2002/0085051 A1* 7/2002 Saruta ..... 347/19
2005/0157101 A1* 7/2005 Silverbrook ..... 347/85

FOREIGN PATENT DOCUMENTS

JP H08-267785 A 10/1996
JP 2001-105625 A 4/2001
JP 2001-353880 A 12/2001
JP 2003-011469 A 1/2003

* cited by examiner

*Primary Examiner* — Julian Huffman
(74) *Attorney, Agent, or Firm* — Baker Botts L.L.P.

(57) ABSTRACT

A liquid ejection device includes a liquid ejection head and a cartridge mounting portion configured to selectively mount an initial liquid cartridge and a replacement liquid cartridge The liquid ejection device also includes a controller configured to determine whether a mounting action of the liquid cartridge to the cartridge mounting portion has occurred, determine whether the liquid cartridge mounted by the mounting action is the initial liquid cartridge or the replacement liquid cartridge, and determine whether liquid has been initially introduced to the liquid ejection head. When the controller determines that the mounting action has occurred and the liquid cartridge mounted by the mounting action is the initial liquid cartridge after liquid has been initially introduced to the liquid ejection head, the controller prevents the initial liquid cartridge from being used or gives warning.

3 Claims, 9 Drawing Sheets

LIQUID EJECTION DEVICES

CROSS REFERENCE TO RELATED APPLICATION

The present application claims priority from Japanese Patent Application No. 2009-064088, which was filed on Mar. 17, 2009, the disclosure of which is incorporated herein by reference in its entirety.

BACKGROUND OF THE INVENTION

1. Field of the Invention

The present invention relates to liquid ejection devices configured to eject liquid droplets.

2. Description of Related Art

Known liquid ejection devices, e.g., inkjet printers, are configured to removably mount thereon liquid cartridges containing liquid for use in liquid ejection heads. A known inkjet printer ejects ink on various recording mediums to form a desired text, image or combination thereof. The inkjet printer is configured to removably mount thereon liquid cartridges containing different color inks.

There are two types of ink cartridges to be mounted to a known inkjet printer, as described in Japanese Laid-Open Patent Publication No. 2001-353880. One is an initial ink cartridge packed with a new inkjet printer. The other is a replacement ink cartridge that users will purchase at retailers separately from an inkjet printer when ink in the ink cartridge mounted to their inkjet printer runs out. The initial ink cartridge contains a greater initial amount of ink than the replacement ink cartridge contains because a partial amount of ink contained in the initial ink cartridge is to be initially introduced to e.g., an inkjet head and/or a sub-tank of the printer, before the printer is initially used.

It will be rare but may happen that an initial ink cartridge is replaced not with a replacement ink cartridge but with another initial ink cartridge, which may be possibly placed on the market without being packed with a new inkjet printer for some reasons. Thus, users may unintentionally mount the initial ink cartridges on their printers more than once.

When an ink cartridge is replaced with new one after ink has been initially introduced to an inkjet head of an inkjet printer, mounting of an initial ink cartridge, instead of a replacement ink cartridge, may cause problems to the inkjet printer, due to differences in initial amounts of ink contained in the initial ink cartridge and the replacement ink cartridge. For example, an initial ink cartridge, which contains a greater initial amount of ink than a replacement ink cartridge contains, is mounted to the inkjet printer, a level of the ink in the initial ink cartridge is positioned higher, as compared with the case when a replacement ink cartridge is mounted to the inkjet printer. This causes higher pressure, e.g., hydraulic head pressure, to be applied to nozzles of an inkjet head, than a specified design value and the higher pressure may cause meniscuses in the nozzles to break.

SUMMARY OF THE INVENTION

Therefore, a need has arisen for liquid ejection devices which overcome these and other shortcomings of the related art. A technical advantage of the present invention is to provide liquid ejection devices that reduce usage of unintendedly mounted initial liquid cartridges configured to contain a greater initial amount of liquid than a replacement liquid cartridge contains, after liquid has been initially introduced to a liquid ejection head.

According to an embodiment of the present invention, a liquid ejection device comprises a liquid ejection head configured to eject liquid and a cartridge mounting portion configured to removably mount thereon a liquid cartridge configured to contain liquid therein, and configured to supply liquid from the liquid cartridge mounted on the cartridge mounting portion to the liquid ejection head. The cartridge mounting portion is configured to selectively mount an initial liquid cartridge that contains a first initial amount of liquid, a partial amount of which is to be initially introduced to the liquid ejection head before the liquid ejection device is initially used, and a replacement liquid cartridge that contains a second initial amount of liquid, wherein the second initial amount is less than the first initial amount. The liquid ejection device also comprises a controller configured to perform a cartridge mounting determination in which it is determined whether a mounting action of the liquid cartridge to the cartridge mounting portion has occurred, a cartridge type determination in which it is determined whether the liquid cartridge mounted by the mounting action is the initial liquid cartridge or the replacement liquid cartridge, and an initial introduction determination in which it is determined whether liquid has been initially introduced to the liquid ejection head. When the controller determines that the mounting action has occurred and the liquid cartridge mounted by the mounting action is the initial liquid cartridge after liquid has been initially introduced to the liquid ejection head, the controller prevents the initial liquid cartridge from being used or gives warning.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawing.

DETAILED DESCRIPTION OF EMBODIMENTS OF THE INVENTION

Embodiments of the present invention, and their features and advantages, may be understood by referring to FIGS. 1-9, like numerals being used for like corresponding parts in the various drawings.

Figure 1:
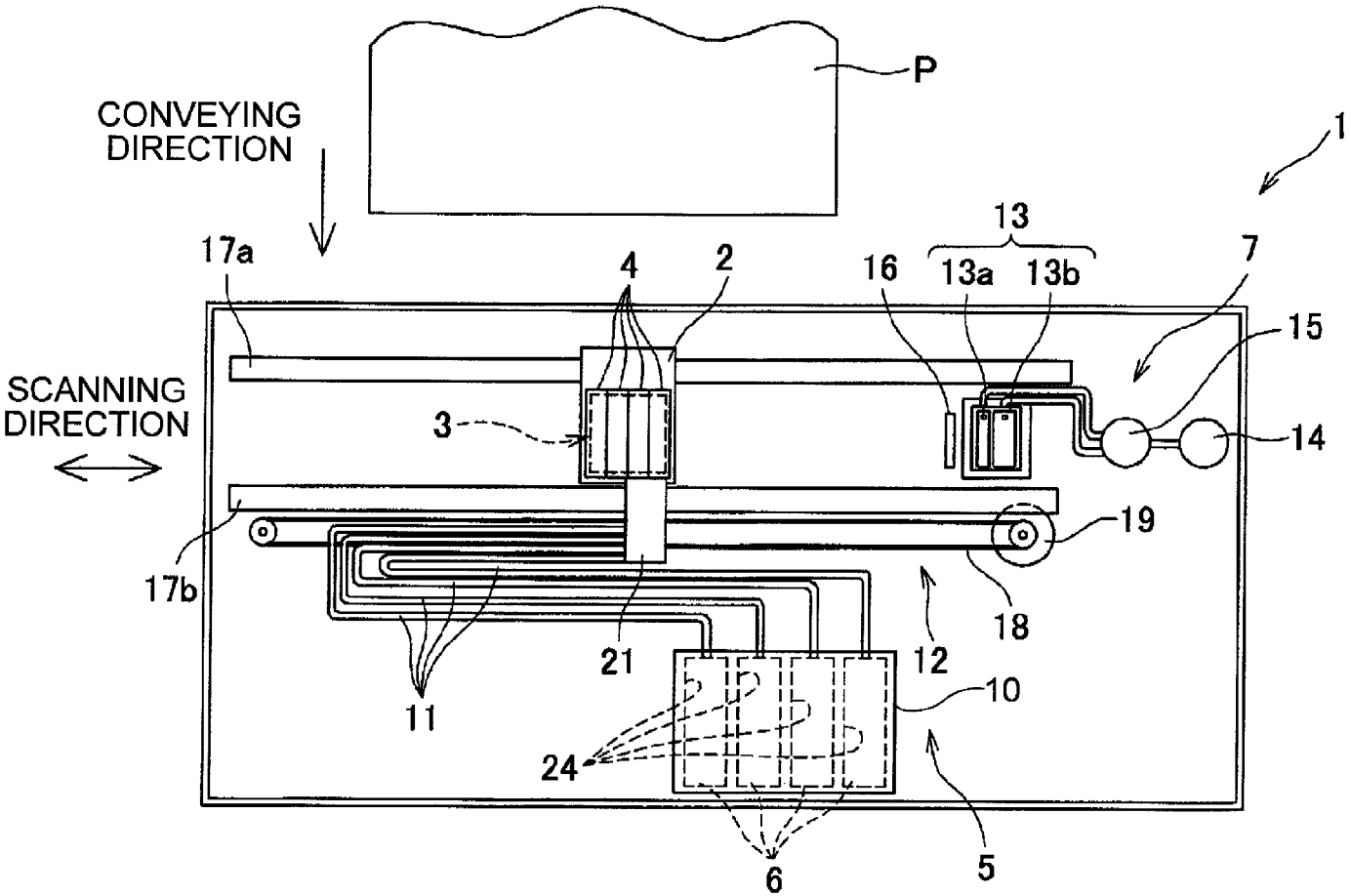
FIG. 1 is a plan view of a printer according to an embodiment of the present invention.

Referring to FIG. 1, a liquid ejection device, e.g., an inkjet printer 1, may comprise a carriage 2 configured to reciprocate in one direction, e.g., a scanning direction or the right-left direction in FIG. 1, a liquid ejection head, e.g., an inkjet head 3, and sub-tanks 4 configured to be mounted on carriage 2, an ink supply device 5 comprising a holder 10 configured to removably mount thereon liquid cartridges, e.g., ink cartridges 6, containing liquid, e.g., ink, a maintenance mechanism 7 configured to recover liquid ejection performances of inkjet head 3 when they are lowered due to inclusion of air in inkjet head 3, and a controller 8 (in FIG. 7) configured to control components of printer 1.

Printer 1 may further comprise guide frames 17*a*, 17*b* that extend parallel to a horizontal direction, e.g., scanning direction. Guide frames 17*a*, 17*b* may be positioned with some distance therebetween in a conveying direction perpendicular to the scanning direction. Carriage 2 may be coupled to guide frames 17*a*, 17*b*. Carriage 2 may be reciprocated by a carriage drive mechanism 12 in the scanning direction while being guided by guide frames 17*a*, 17*b*. Carriage drive mechanism 12 may comprise an endless belt 18 coupled to carriage 2, and a carriage drive motor 19 configured to drive endless belt 18. When endless belt 18 is driven by carriage drive motor 18 and runs, carriage 2 may move in the scanning direction.

Figure 2:
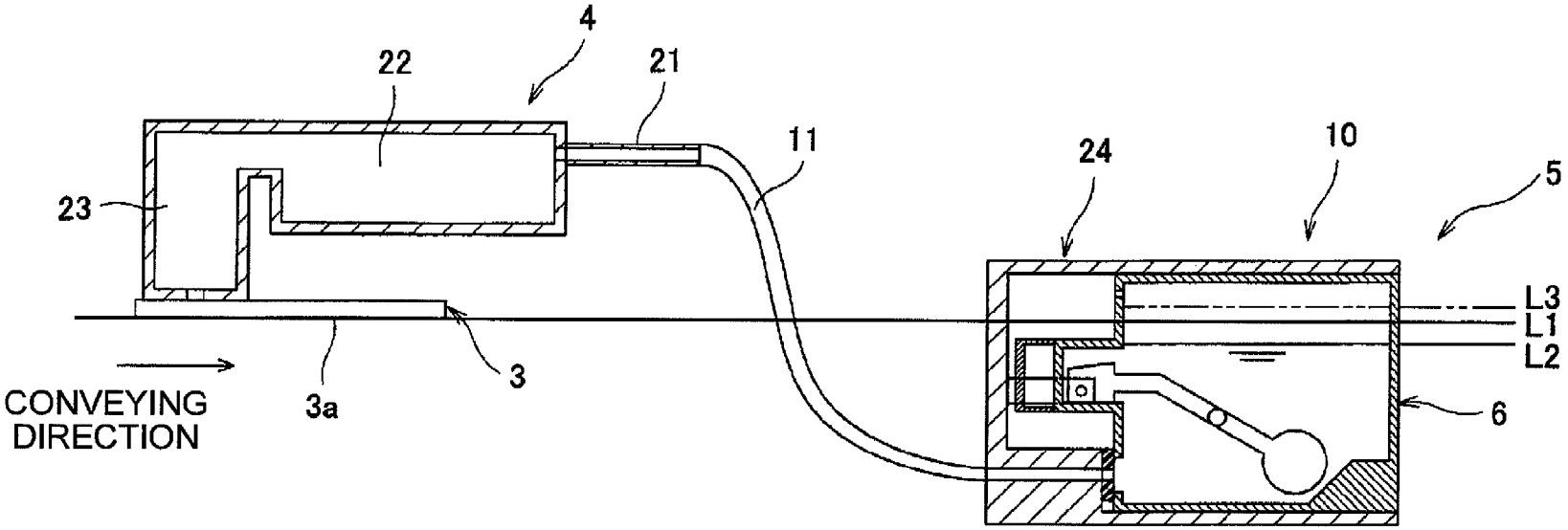
FIG. 2 is a vertical cross-sectional view of a sub-tank, an inkjet head, and an ink supply device of the printer of FIG. 1.

Carriage 2 may mount thereon inkjet head 3 and four sub-tanks 4. Sub-tanks 4 may be arranged in line along the scanning direction. Inkjet head 3 may be positioned at a lower end of each sub-tank 4. Referring to FIG. 2, each sub-tank 4 may comprise an ink chamber 22 configured to contain ink, and a communication passage 23 that communicates with ink chamber 22 and extends downward in the vertical direction. Ends of sub-tanks 4*a*-4*d* may be integrally provided with a tube joint 20. Ink chamber 22 of sub-tank 4 may be connected to ink supply device 5, via flexible tubes 11 coupled to tube joint 21. A lower end of communication passage 23 may be connected to an ink supply opening (not shown) formed in an upper surface of inkjet head 3. Ink supplied from ink supply device 5, via tubes 11, may be contained in ink chamber 22. Ink in ink chamber 22 may be supplied to inkjet head 3, via communication passage 23.

A lower surface of inkjet head 3 may comprise a liquid ejection surface 3*a*. Liquid ejection surface 3*a* may have nozzles formed therein. While inkjet head 3 reciprocates in the scanning direction together with carriage 2, ink supplied from sub-tanks 4 may be ejected from the nozzles onto a recording sheet P being conveyed in the conveying direction by a conveying mechanism 9 (in FIG. 7). Conveying mechanism 9 may comprise a sheet conveying motor 27 and a sheet output motor 28. Thus, a desired image, text or combination thereof may be recorded or printed on recording sheet P.

Referring to FIGS. 1 and 2, ink supply device 5 may comprise four ink cartridges 6 containing different color inks, e.g., a black ink, a cyan ink, a magenta ink, and a yellow ink, and holder 10, which may comprise four cartridge mounting portions 24. Ink cartridges 6 may be removably mounted to respective cartridge mounting portions 24. Color inks contained in four ink cartridges 6 may be supplied to sub-tanks 4, via tubes 11 coupled to holder 10.

Referring to FIG. 1, maintenance mechanism 7 may be disposed at a position, e.g., a maintenance position, outside a printing area, e.g., right side in FIG. 1, in a movement range of carriage 2 with respect to the scanning direction. In the printing area, carriage 2 may face recording sheet P. Maintenance mechanism 7 may comprise a cap member 13 configured to make intimate contact with a lower surface of inkjet head 3, e.g., liquid ejection surface 3*a*, a suction pump 14 connected to cap 13, and a wiper 16 configured to wipe off ink adhering to liquid ejection surface 3*a*.

When carriage 2 moves to the maintenance position to recover the liquid ejection performances of inkjet head 3, cap 13 may face liquid ejection surface 3*a*. A cap drive device 25 (in FIG. 7) may drive cap 13 in an upward direction, e.g., in a direction toward the front side of the sheet of FIG. 1, to make intimate contact with liquid ejection surface 3*a*. Thus, cap 13 may cover the nozzles of inkjet head 3 at one time.

Cap 13 may be connected to suction pump 14, via a switching unit 15. With cap 13 covering the nozzles positioned in liquid ejection surface 3*a*, suction pump 14 may be operated to suction ink from the nozzles. Thus, ink in the nozzles that becomes viscous due to drying or air bubbles included in inkjet head 3 may be removed or purged from the nozzles. After ink is purged from the nozzles, cap 13 may move downward away from liquid ejection surface 3*a*. In this state, inkjet head 3 may move together with carriage 2 in the scanning direction relative to wiper 16, to wipe off ink adhering to liquid ejection surface 3*a*.

Cap 13 may comprise a first cap 13*a* configured to cover nozzles for black ink and a second cap 13*b* configured to cover nozzles for other three colors of ink. A purging operation may be performed separately for the nozzles for black ink and the nozzles for other three colors of ink. Switching unit 15 may selectively connect one of first cap 13*a* and second cap 13*b* to suction pump 14.

In ink supply device 5, cartridge mounting portion 24 may be configured to selectively mount thereon two types of ink cartridges 6*a*, 6*b* which contain the same color of ink but different initial amounts of ink. One type of ink cartridge 6*a* may be an initial ink cartridge that may be mounted to cartridge mounting portion 24 when inkjet printer 1 is initially used. The other type of ink cartridge 6*b* may be a replacement ink cartridge that is mounted to cartridge mounting portion 24 as a replacement for an empty ink cartridge 6. Initial ink cartridge 6*a* shown in FIG. 3A may contain a greater initial amount of ink than replacement ink cartridge 6*b* shown in FIG. 3B contains, because a partial amount of ink contained in initial ink cartridge 6*a* may be initially introduced to inkjet head 3 before printer 1 is initially used. In other words, initial ink cartridge 6*a* may contain a first initial amount of ink, replacement ink cartridge 6*b* may contain a second initial amount of ink, and the second initial amount may be less than the first initial amount.

Figure 3A:
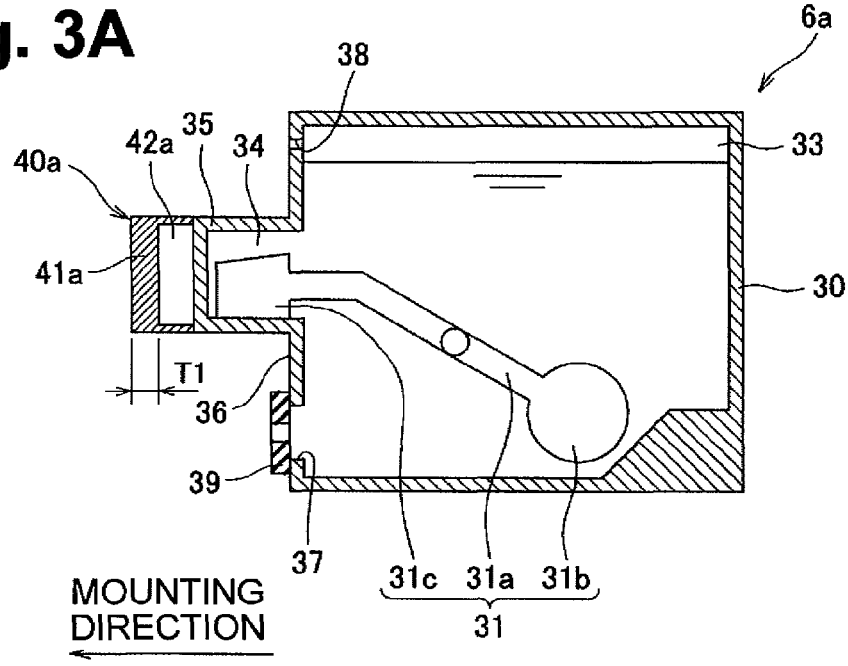
FIGS. 3A and 3B are cross-sectional views of an initial ink cartridge and a replacement ink cartridge configured to be mounted to the printer of FIG. 1, respectively.
Figure 3B:
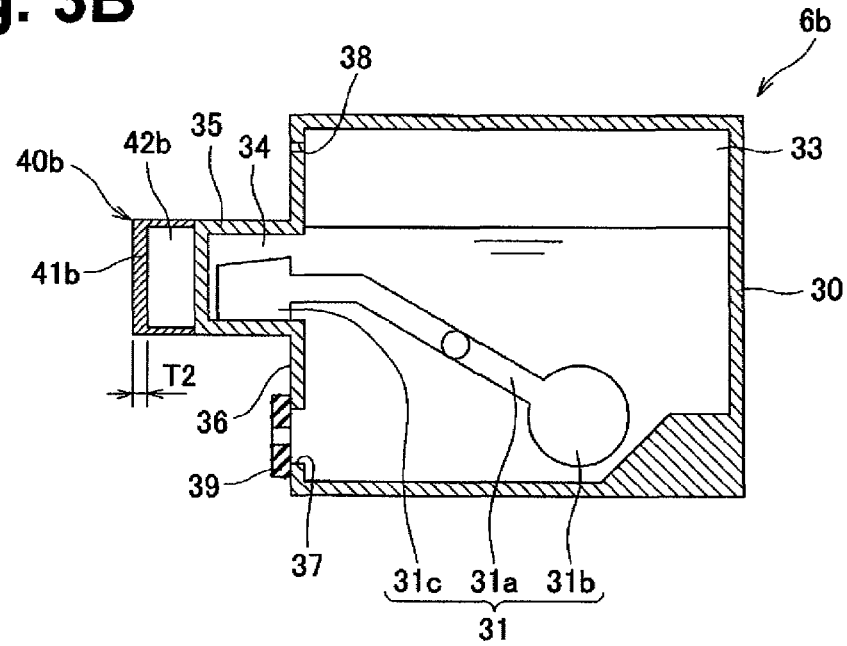

Ink cartridges 6*a*, 6*b* may be similarly structured, except some portions. Therefore, the same or similar structures between ink cartridges 6*a*, 6*b* may be described in conjunction with ink cartridge 6, without specifying types of ink cartridges 6*a*, 6*b*. Different structures between ink cartridges 6*a*, 6*b* may be described with types of ink cartridges 6*a*, 6*b* specified. In FIGS. 3A and 3B, a mounting direction of ink cartridge 6 to holder 10 (cartridge mounting portion 24) may be defined as a frontward direction. A removal direction of ink cartridge 6 from holder 10, opposite to the mounting direction, may be defined as a rearward direction. Unless otherwise specified, the front, rear, top and bottom of ink cartridge 6 (6*a*, 6*b*) may be defined in conjunction with an orientation in which ink cartridge 6 is mounted to holder 10 (cartridge mounting portion 24). More specifically, left, right, top, and bottom sides in FIGS. 3A and 3B may be defined as front, rear, top, and bottom sides of ink cartridges 6*a* and 6*b*, respectively.

Referring to FIGS. 3A and 3B, ink cartridge 6 may comprise a cartridge body 30 an ink supply opening 37 formed through cartridge body 30, and a sensor arm 31 positioned in cartridge body 30. Cartridge body 30 may be configured to contain ink therein. Sensor arm 31 may be configured to be used for determining a residual amount of ink remaining in cartridge body 30.

Cartridge body 30 may comprise a light-transmittable material, e.g., synthetic resin material. Cartridge body 30 may have a substantially hexahedron shape. An interior of cartridge body 30 may comprise an ink chamber 33 configured to contain ink therein. Cartridge body 30 may further comprise a protrusion 35 having a sensor room 34 formed therein. Sensor room 34 may communicate with ink chamber 33. Protrusion 35 may extend frontward from a front wall 36 of cartridge body 30. A light blocking plate 31*c* of sensor arm 31 may be positioned in sensor room 34 inside protrusion 35.

Ink supply opening 37 may be positioned at a lower end of front wall 36 of cartridge body 30. Ink supply opening 37 may communicate with a lower space of ink chamber 33. Ink may be supplied from ink chamber 33 through ink supply opening 37. Annular sealing member 39 may be attached to a portion of front wall 36 where ink supply opening 37 is formed. Sealing member 39 may comprise rubber. An air communication opening 38 may be positioned at an upper end of front wall 36. Air communication opening 38 may communicate with an upper space of ink chamber 33. Air may be introduced into ink chamber 33 through air communication opening 38.

Sensor arm 31 may comprise an arm portion 31*a*, a float 31*b* and a light blocking plate 31*c*. Arm portion 31*a* may be pivotally supported in ink chamber 33 by cartridge body 30. Float 31*b* may be positioned at an end of arm portion 31*a*. Float 31*b* may be configured to move up and down in accordance with an amount of ink in ink chamber 33. Light blocking plate 31*c* may be positioned at an end of arm portion 31*a* opposite to float 31*b*. Light blocking plate 31*c* may be positioned inside sensor room 34. Light blocking plate 31*c* may be configured to block light emitted from an optical sensor 53 (in FIG. 4) positioned in cartridge mounting portion 24 when ink cartridge 6 is mounted on cartridge mounting portion 24 and light blocking plate 31*c* is in the lowest position contacting a bottom surface of sensor room 34.

When float 31*b* moves up and down in accordance with an amount of ink in ink chamber 33, light blocking plate 31*c* connected to float 31*b* via arm portion 31*a* may be configured to move up and down relative to cartridge body 30 in sensor room 34. More specifically, when there is sufficient ink in ink chamber 33, light blocking plate 31*c* may contact the bottom surface of sensor room 34, because relatively large buoyancy may be applied to float 31*b* and moment in the counterclockwise direction in FIGS. 3A and 3B may be applied to arm portion 31*a*. Therefore, light blocking plate 31*e* may contact the bottom surface of sensor room 34. When an amount of ink in ink chamber 33 is reduced, a portion of float 31*b* may be exposed above the surface of ink. Thereafter, float 31*b* may follow the drop of the ink level and accordingly arm portion 31*a* may pivotally move in a clockwise direction in FIGS. 3A and 3B. Float 31*b* may eventually contact the bottom surface of ink chamber 33 and light blocking plate 31*c* may contact an upper surface of sensor room 34.

A light blocking member 40*a* and 40*b* may be attached to protrusion 35 of cartridge body 30 of each initial ink cartridge 6*a* and replacement ink cartridge 6*b*, respectively. Referring to FIG. 3A, light blocking member 40*a* may comprise a light blocking portion 41*a* positioned in front of protrusion 35. Light blocking portion 41*a* may have a thickness T1 in the mounting direction. A space 42*a* may be formed between light blocking portion 41*a* and a front surface of protrusion 35. Referring to FIG. 3B, light blocking member 40*b* may comprise a light blocking portion 41*b* positioned in front of protrusion 35. Light blocking portion 41*b* may have a thickness T2 in the mounting direction. A space 42*b* may be formed between light blocking portion 41*b* and a front surface of protrusion 35. Thickness T1 of light blocking portion 41*a* of initial ink cartridge 6*a* may be greater than thickness T2 of light blocking portion 41*b* of replacement ink cartridge 6*b*.

Light blocking portions 41*a*, 41*b* may be configured to temporarily block light from optical sensor 53 (in FIG. 4) positioned in cartridge mounting portion 24 during mounting action of ink cartridges 6*a*, 6*b* to cartridge mounting portion 24. Light blocking portions 41*a*, 41*b* may have different thickness T1, T2. Therefore, the length of time that light blocking portions 41*a*, 41*b* block the light from optical sensor 53 may differ. Due to the differences in the light blocking time by light blocking portions 41*a*, 41*b*, it may be determined which ink cartridge 6*a*, 6*b* is mounted by the mounting action to cartridge mounting portion 24.

Referring to FIG. 1, holder 10 may comprise four cartridge mounting portions 24 to which ink cartridges 6 are mounted. Four cartridge mounting portions 24 may be arranged in one direction, e.g., parallel to the scanning direction. Four cartridge mounting portions 24 may have the same or similar structures. Therefore, one cartridge mounting portion 24 will be described in detail below.

Figure 4:
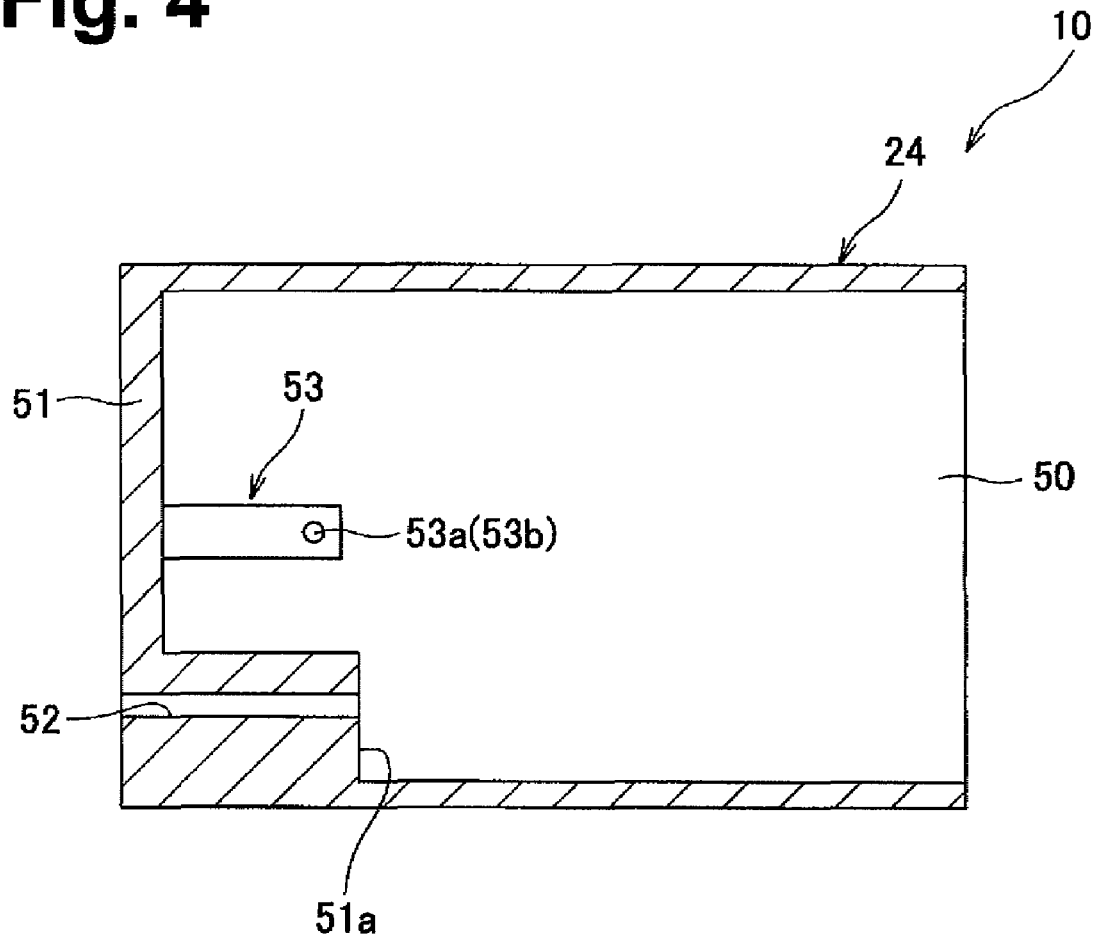
FIG. 4 is a cross-sectional view of a holder of the printer of FIG. 1 in which the initial ink cartridge of FIG. 3A or the replacement ink cartridge of FIG. 3B is not mounted on the holder.

Referring to FIG. 4, cartridge mounting portion 24 of holder 10 may comprise a cartridge accommodating chamber 50, an ink supply passage 52, and optical sensor 53. Cartridge accommodating chamber 50 may have a box shape with an open end facing rearward. Ink supply passage 52 may be formed through a front wall 51 of holder 10 defining cartridge accommodating chamber 50. Optical sensor 53 may be positioned on front wall 51.

Ink cartridge 6 may be inserted into cartridge accommodating chamber 50 through the open end facing rearward. A lower portion of front wall 51 may comprise an extended portion 51*a* that may extend more rearward than an upper portion of front wall 51. Ink supply passage 52 may be positioned in extended portion 51*a*. Ink supply passage 52 may be connected to inkjet head 3 via tube 11, as shown in FIG. 2. Optical sensor 53 may be positioned at a central portion of front wall 51 in its vertical direction. Optical sensor 53 may comprise a transmissive optical sensor comprising a light emitting portion 53*a* and a light receiving portion 53*b*. Light emitting portion 53*a* and light receiving portion 53*b* may face each other with a predetermined distance therebetween in a direction perpendicular to the sheet of FIG. 4. Optical sensor 53 may output a signal, e.g., an ON signal, to controller 8 when light emitted from light emitting portion 53*a* is blocked by an object to be detected, e.g., ink cartridge 6, and is not received by light receiving portion 53*b*. When light from light emitting portion 53*a* is received by light receiving portion 53*b*, optical sensor 53 may not output a signal to controller 8, e.g., optical sensor 53 may output an OFF signal to controller 8.

Signals output by optical sensor 53 may be used for determining whether the mounting action of ink cartridge 6 to cartridge mounting portion 24 has occurred, determining the type of ink cartridge 6 mounted by the mounting action to cartridge mounting portion 24, and determining the residual ink amount in ink cartridge 6 mounted on cartridge mounting portion 24, e.g., determining whether ink cartridge 6 mounted on cartridge mounting portion 24 contains a predetermined amount or more of ink. These determinations may be described in detail below in conjunction with the mounting action of ink cartridge 6 to cartridge mounting portion 24.

Figure 5A:
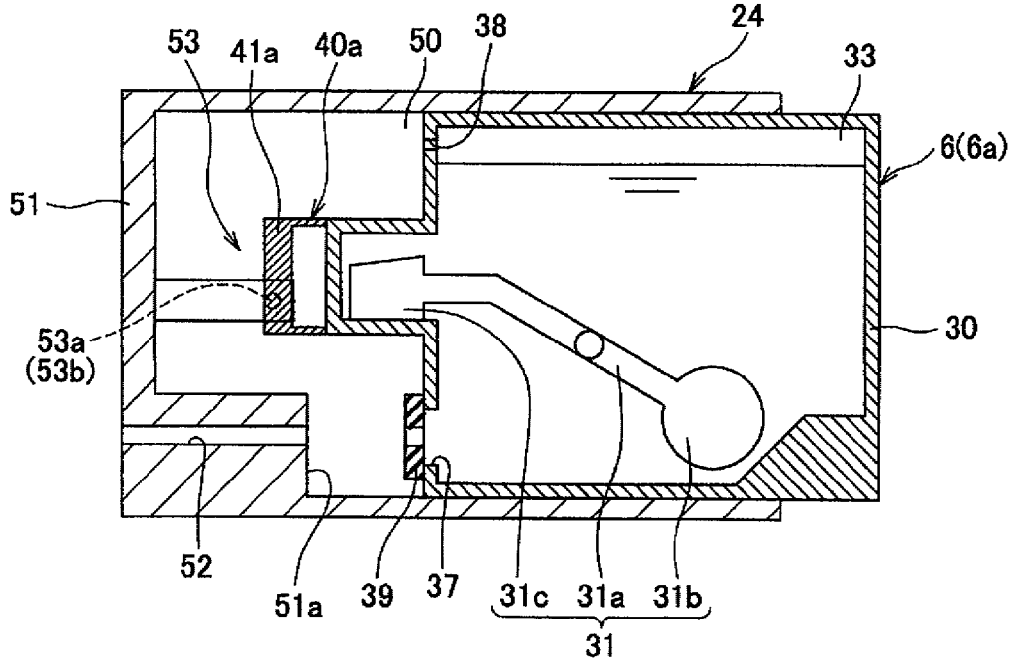
FIG. 5A is a cross-sectional view of the holder of the printer of FIG. 1 in which the initial ink cartridge of FIG. 3A is being mounted to the holder.
Figure 5B:
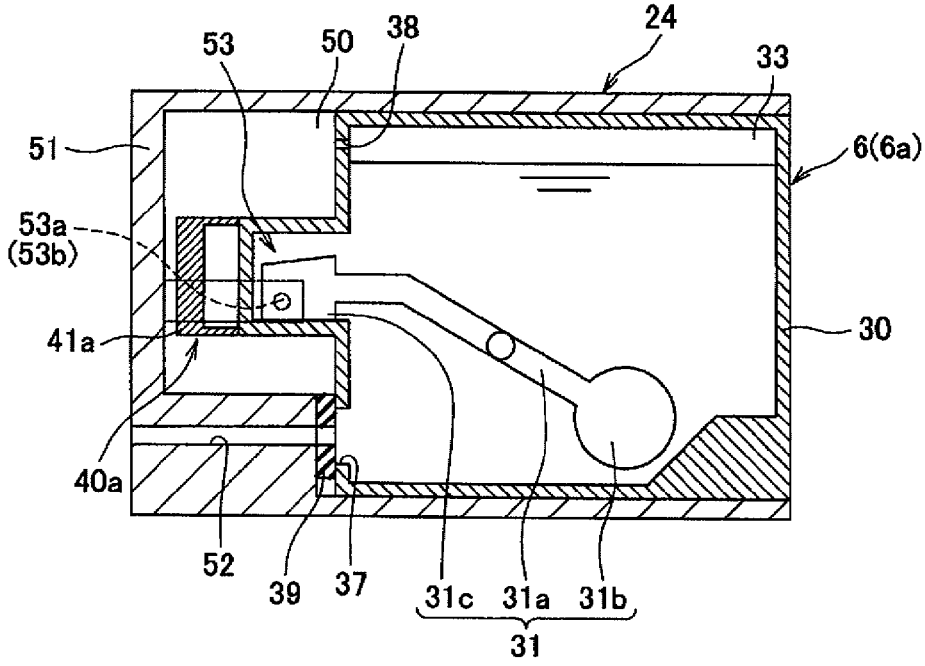
FIG. 5B is a cross-sectional view of the holder of the printer of FIG. 1 in which mounting of the initial ink cartridge of FIG. 3A to the holder has been completed.

Ink cartridge 6 is mounted to the cartridge mounting portion 24 by being inserted into cartridge accommodating chamber 50 via the open end. When ink cartridge 6 is inserted into cartridge accommodating chamber 50 of cartridge mounting portion 24, cartridge body 30 may contact extended portion 51*a* of front wall 51 via sealing member 39, as shown in FIGS. 5A and 5B. Please note that FIGS. 5A and 5B show initial ink cartridge 6*a*. When cartridge body 30 contacts extended portion 51*a* via sealing member 39, ink supply passage 52 formed in extended portion 51*a* and ink supply opening 37 formed in cartridge body 30 may communicate with each other. At this time, air communication opening 38 formed in cartridge body 30 may open. Consequently, air may be introduced into ink chamber 33 through air communication opening 38. Ink in ink chamber 33 may be supplied through ink supply opening 37 to ink supply passage 52 of holder 10.

During the mounting action of ink cartridge 6 to cartridge mounting portion 24, protrusion 35 positioned in cartridge body 30 and light blocking portion 41 of light blocking member 40 attached to protrusion 35 may be inserted between light emitting portion 53*a* and light receiving portion 53*b* of optical sensor 53.

Figure 6A:
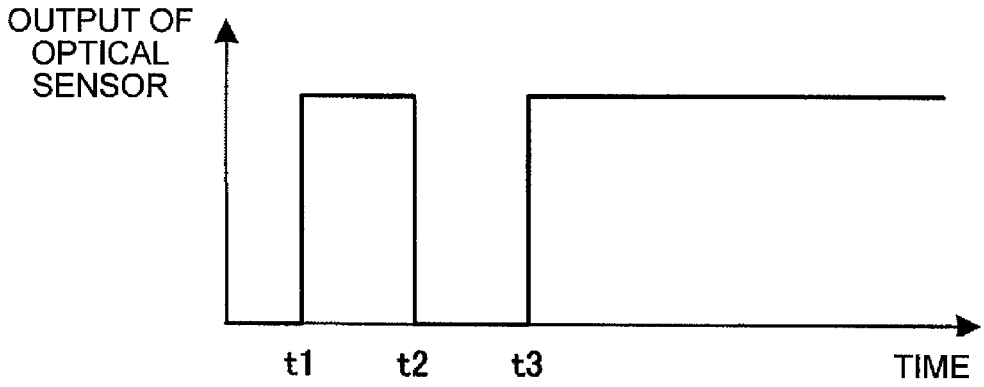
FIG. 6A is a schematic showing an output waveform of an optical sensor of the printer of FIG. 1 when a mounting action of the initial ink cartridge of FIG. 3A to the printer occurs.
Figure 6B:
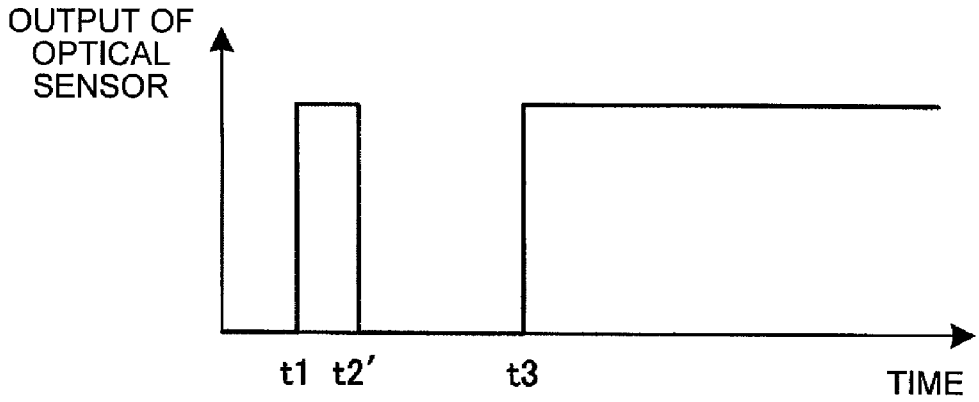
FIG. 6B is a schematic showing an output waveform of the optical sensor of the printer of FIG. 1 when a mounting action of the replacement ink cartridge of FIG. 3B to the printer occurs.

When light blocking portion 41 of light blocking member 40 temporarily blocks light from light emitting portion 53*a*, as shown in FIG. 5A, output signal of optical sensor 53 to controller 8 may change from the OFF signal (light is not blocked) to the ON signal (light is blocked: t1), and then to the OFF signal (light is not blocked: t2), as shown in FIG. 6A. With this change in output signal of optical sensor 53, controller 8 may determine that the mounting action of ink cartridge 6 to cartridge mounting portion 24 has occurred. Assuming that the moving speed of ink cartridge 6 during the mounting action to cartridge mounting portion 24 would not suddenly change or would not vary so much depending on a user, the length of time that light blocking portion 41 blocks light may generally be proportional to the thickness of light blocking portion 41. Therefore, as shown in FIGS. 6A and 6B, the length of time in which light is blocked, e.g., the length of time in which the ON-signal is output, may differ between ink cartridges 6*a* and 6*b*. More specifically, the length of time in which light is blocked, e.g., the first pulse length between t1 and t2, when initial ink cartridge 6*a* is mounted to cartridge mounting portion 24 may differ from the length of time in which light is blocked, e.g., the first pulse length between t1 and t2', when replacement ink cartridge 6*b* is mounted to cartridge mounting portion 24. Thus, controller 8 may determine which ink cartridge 6*a* or 6*b* is mounted by the mounting action to cartridge mounting portion 24. In another embodiment, printer 1 may comprise a mechanism configured to automatically mount ink cartridge 6 to cartridge mounting portion 24. In such a case, the length of time in which light is blocked may differ between ink cartridges 6*a* and 6*b*.

When ink cartridge 6 mounted to cartridge mounting portion 24 contains a predetermined amount or more of ink, as shown in FIG. 5B, relatively large buoyancy may be applied to float 31*b* in ink. Therefore, light blocking plate 31*c* of sensor arm 31 may be in the lowest position in which light blocking plate 31*c* contacts the bottom surface of sensor room 34. At this time, light blocking plate 31*c* may block light emitted from light emitting portion 53*a*, and light receiving portion 53*b* may not receive the light. Referring to FIGS. 6A and 6B, output signal of optical sensor 53 may change from the OFF signal (light is not blocked) to the ON signal (light is blocked: t3). Thus, controller 8 may determine that ink cartridge 6 contains the predetermined amount or more of ink, e.g., an amount of ink that a portion of float 31*b* is exposed above the surface of ink.

After ink cartridge 6 is mounted on cartridge mounting portion 24, ink may be ejected from inkjet head 3 and consumed. As ink in ink cartridge 6 is reduced, float 31*b* may be lowered. Consequently, light blocking plate 31*c* of sensor arm 31 may move to an uppermost position in which light blocking plate 31*c* contacts an upper surface of sensor room 34. At this time, light blocking plate 31*c* may not block light emitted from light emitting portion 53*a*. The light from light emitting portion 53*a* may pass though ink cartridge 6 and be received by light receiving portion 53*b*. Optical sensor 53 may output the OFF signal to controller 8. Controller 8 may determine that the amount of ink in ink cartridge 6 may be reduced to less than the predetermined amount, e.g., a near empty state.

Figure 7:
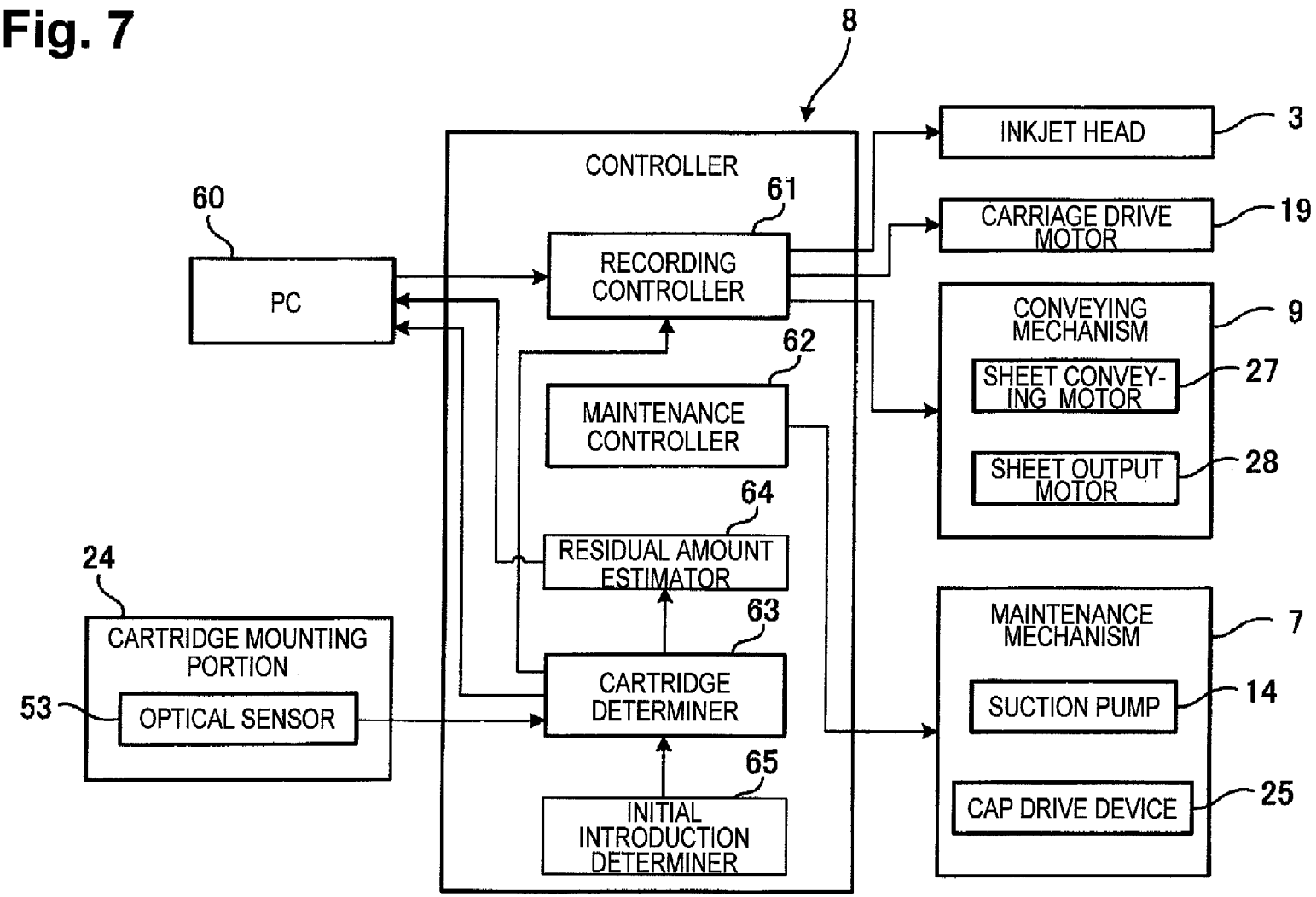
FIG. 7 is a block diagram showing electrical configuration of the printer of FIG. 1.

Referring to FIG. 7, controller 8 of printer 1 may comprise a central processing unit (CPU), a read only memory (ROM) configured to store programs and data for controlling overall operations of printer 1, and a random access memory (RAM) configured to temporarily store data to be processed by CPU. CPU may execute programs stored in ROM to perform various controls, such as those described below. In another embodiment, controller 8 may comprise hardware comprising various circuits comprising arithmetic circuits.

Controller 8 may function as a recording controller 61, a maintenance controller 62, a cartridge determiner 63, a residual amount estimator 64 and an initial introduction determiner 65.

Recording controller 61 may control inkjet head 3, carriage drive motor 19 configured to drive carriage 2, sheet conveying motor 27 and sheet output motor 28 of conveying mechanism 9, to record a desired text, image or combination thereof on recording sheet P, based on recording data input from a personal computer (PC) 60 connected to printer 1. Maintenance controller 62 may control cap drive device 25 and suction pump 14 of maintenance mechanism 7 to execute a purging operation for inkjet head 3.

Cartridge determiner 63 may determine whether a mounting action of ink cartridge 6 to cartridge mounting portion 24 has occurred, whether ink cartridge 6 mounted by the mounting action is ink cartridge 6*a* or 6*b*, and whether a residual amount of ink in ink cartridge 6 mounted on the cartridge mounting portion 24 is less than the predetermined amount, e.g., whether ink cartridge 6 is in a near empty state, based on signals output from optical sensor 53, as shown in FIGS. 6A and 6B. When ink is ejected from inkjet head 3 with ink cartridge 6 being in the near empty state, e.g., in a state in which ink in ink cartridge 6 is very small and almost empty, air may be pulled into inkjet head 3. To prevent this, whether ink cartridge 6 is in the near empty state may be determined. When cartridge determiner 63 determines that ink cartridge 6 is in the near empty state, cartridge determiner 63 may send such information to PC 60.

When cartridge determiner 63 determines that ink cartridge 6 is mounted to cartridge mounting portion 24, residual amount estimator 64 may estimate the residual ink amount in ink cartridge 6, based on a preset amount of ink and an amount of ink consumed by inkjet head 3 from the time when it is determined that the mounting action of ink cartridge 6 to cartridge mounting portion 24 has occurred. The preset amount of ink 6 may be prestored in ROM. The estimated residual ink amount in ink cartridge 6 may indicated by a display of PC 60 or a display e.g., liquid crystal display, of printer 1 to inform a user of an approximate amount of residual ink in ink cartridge 6.

The preset amount of ink may equal to the second initial amount of ink that replacement ink cartridge 6*b* contains The amount of ink consumed by inkjet head 3 may comprise an amount of ink consumed by ejecting ink droplets onto recording sheet P during a recording operation, an amount of ink consumed at a time other than the recording operation, e.g., amounts of ink consumed during a purging operation by maintenance mechanism 7 and a flushing operation that may be performed before, during, and after the recording operation. More specifically, residual amount estimator 64 may calculate the number of ink droplets ejected during a recording operation and the number of purging and flushing operations performed. Further, residual amount estimator 64 may refer to data, prestored in ROM, of the volumes of ink droplets, and amounts of ink to be consumed during one purging operation and one flushing operation, to calculate a total amount of ink consumed in inkjet head 3. Residual amount estimator 64 may send information on the estimated residual ink amount in ink cartridge 6 to the display of PC 60 or the display of printer 1.

PC 60 may cause the display of PC 60 to display the estimated residual ink amount in ink cartridge 6, based on the information sent from residual amount estimator 64. When cartridge determiner 63 sends information on the near empty state of ink cartridge 6, PC 60 may cause the display of PC 60 to display such information, to let a user recognize that the residual ink amount in ink cartridge 6 is very small. Similarly, the display of printer 1 may be caused to display the estimated residual ink amount in ink cartridge 6, based on the information sent from residual amount estimator 64, and may be caused to display information on the near empty state of ink cartridge 6.

As described above, cartridge mounting portion 24 of holder 10 may be configured to selectively mount thereon two types of initial ink cartridge 6*a* and replacement ink cartridge 6*b*. The first initial amount of ink contained in initial ink cartridge 6*a* may be greater than the second initial amount of ink contained in replacement ink cartridge 6*b*, because initial ink cartridge 6*a* may contain extra ink that is to be initially introduced to inkjet head 3, sub-tanks 4 and tubes 11, before printer 1 is initially used.

When new printer 1 is initially used, initial ink cartridge 6*a*, which is packed with new printer 1, may be mounted to cartridge mounting portion 24 of holder 10. When cartridge determiner 63 determines that ink cartridge 6 mounted by the mounting action is initial ink cartridge 6*a*, maintenance controller 62 may control suction pump 14 and cap drive device 25 of maintenance mechanism 7, to perform suctioning from the nozzles of inkjet head 3. Thus, ink in initial ink cartridge 6*a* may be initially introduced to inkjet head 3.

Initial introduction determiner 65 may determine whether ink has been initially introduced to inkjet head 3. In this embodiment, when a suction volume by suction pump 14 becomes greater than or equal to a predetermined volume, e.g., when the total number of rotations of suction pump 14 from the time when the initial ink introduction is started reaches a predetermined number, initial introduction determiner 65 may determine that ink is introduced to the nozzles of inkjet head 3 and the initial ink introduction is completed, i.e., ink has been initially introduced to inkjet head 3.

An amount of ink contained in initial ink cartridge 6*a* immediately after the initial ink introduction is completed, may be obtained by deducting the amount of ink consumed at the initial ink introduction from the first initial amount of ink contained in initial ink cartridge 6*a*. The amount of ink contained in initial ink cartridge 6*a* immediately after the initial ink introduction may be less than or equal to the second initial amount of ink contained in replacement ink cartridge 6*b*. When the residual ink amount in initial ink cartridge 6*a* immediately after the initial ink introduction is almost the same as the second initial amount of ink contained in replacement ink cartridge 6*b*, residual amount estimator 64 may use the second initial amount of ink as the preset amount of ink for the residual ink estimation to be performed from the time immediately after the initial ink introduction. In other words, the estimation of the residual ink amount in initial ink cartridge 6*a* after the initial ink introduction may be performed similarly as the residual ink estimation is performed when replacement cartridge 6*b* is mounted to cartridge mounting portion 24.

When the residual ink amount in initial ink cartridge 6*a* immediately after the initial ink introduction is less than the second initial amount of ink contained in replacement ink cartridge 6*b*, residual amount estimator 64 may use a predetermined value as the preset amount of ink for the residual ink estimation to be performed from the time immediately after the initial ink introduction. The predetermined value may be less than the second initial amount of ink that replacement ink cartridge 6*b* contains. The predetermined value may be prestored in ROM.

After the initial ink introduction, ink in ink cartridge 6 mounted on cartridge mounting portion 24 may be consumed during, e.g., a recording operation with inkjet head 3 or a purging operation. When cartridge determiner 63 or residual amount estimator 64 determines that ink in ink cartridge 6 runs out, a user may remove ink cartridge 6 from cartridge mounting portion 24 and mount new replacement cartridge 6*b* to cartridge mounting portion 24.

After ink in ink cartridge 6 runs out, ink cartridge 6 may not be replaced with intended replacement cartridge 6*b* but possibly with initial ink cartridge 6*a*, which may contain more ink than replacement cartridge 6*b*. When this occurs, the following problems may be caused.

To stably form meniscuses in the nozzles of inkjet head 3 and to prevent the meniscuses from breaking when pressure in inkjet head 3 slightly changes, negative back pressure may be preferably applied to the meniscuses in the nozzles. To readily realize this, as shown in FIG. 2, a level L1, e.g., a level or height of an ink ejection surface 3*a* of inkjet head 3 having the nozzles formed therein, may be always positioned higher than a level L2 of ink in ink cartridge 6. Generally, negative pressure corresponding to height, e.g., head differential, between level L1 of ink ejection surface 3*a* and ink level L2 may be applied to the nozzles.

It may be assumed that only the mounting action of replacement ink cartridge 6*b* to cartridge mounting portion 24 occurs after initial ink introduction. Therefore, ink level L2 of unused replacement ink cartridge 6*b* may be a reference for determining level L1 of ink ejection surface 3*a* to constantly apply negative pressure to the nozzles. In other words, level L1 of ink ejection surface 3*a* may be positioned higher than ink level L2 of unused replacement ink cartridge 6*b*. Moreover, the ink amount in initial ink cartridge 6*a* immediately after the initial introduction of ink from initial ink cartridge 6*a* may be reduced to an amount less than or equal to the second initial amount of ink contained in replacement ink cartridge 6*b*, because ink may be consumed at the time of the initial ink introduction. Therefore, the ink level of initial ink cartridge 6*a* immediately after the initial introduction of ink may become lower than level L1 of ink ejection surface 3*a*, and therefore determination of level L1 of ink ejection surface 3*a* with reference to ink level L2 of unused replacement ink cartridge 2*b* may not cause any problems.

Nevertheless, the above-mentioned determination of level L1 may not take into consideration the unintended mounting action of initial ink cartridge 6*a* after the initial ink introduction. If unused initial ink cartridge 6*a* is mounted to cartridge mounting portion 24 after the initial ink introduction, the level of ink may become a level L3, as shown in FIG. 2, which may be higher than expected ink level L2. When ink level L3 is positioned higher than ink ejection surface 3*a*, e.g., level L1, positive pressure may be applied to the nozzles. Under a condition in which positive pressure is applied to the nozzles, if pressure changes in inkjet head 3 caused by, e.g., residual pressure wave resulting from the immediately preceding ink droplet ejection or an inertial force during reciprocation of carriage 2, are exerted on the nozzles, meniscuses in the nozzles may break at a timing when ink droplets are not supposed to be ejected. The rise of ink level in ink cartridge 6 may not generate the positive pressure applied to the nozzles, but negative pressure applied to the nozzles may lessen, e.g., may approach atmospheric pressure. If negative pressure applied to the nozzles becomes closer to atmospheric pressure, meniscuses may be more influenced by pressure changes in inkjet head 3.

To solve such problems, level L1 of ink ejection surface 3*a* may be positioned sufficiently higher than ink level L3 of unused initial ink cartridge 6*a*. Nevertheless, this may lead to increase in the physical size of printer 1 because inkjet head 3 needs to be positioned higher from ink supply device 5 comprising ink cartridge 6.

Moreover, residual amount estimator 64 may estimate a residual ink amount of ink cartridge 6, based on the assumption that only the mounting action of replacement ink cartridge 6*b* to cartridge mounting portion 24 occurs after the initial ink introduction. Therefore, the preset amount of ink may be set to the second initial amount of ink that replacement ink cartridge 6*b* contains, for estimating the residual ink amount of ink cartridge 6 when the mounting action of ink cartridge 6 occurs after the initial ink introduction. If the mounting of initial ink cartridge 6*a* unintendedly occurs after the initial ink introduction, the preset amount of ink may not be appropriate for estimating the residual amount of ink cartridge 6*a*. This may cause inaccurate estimation of the residual ink amount and inaccurate display of the residual ink amount by the display of PC 60 or the display of printer 1.

To solve the above-mentioned problems, when cartridge determiner 63 determines that the mounting action of initial ink cartridge 6*a* to cartridge mounting portion 24 occurs after initial introduction determiner 65 determines the initial ink introduction to inkjet head 3 has been performed, use of initial ink cartridge 6*a* may be prevented. More specifically, recording controller 61 may control inkjet head 3 not to record an image, text or combination thereof on recording sheets P until initial ink cartridge 6*a* is replaced with replacement ink cartridge 6*b*. Thus, any problems caused by the unintended mounting of initial ink cartridge 6*a* may be reduced.

Figure 8:
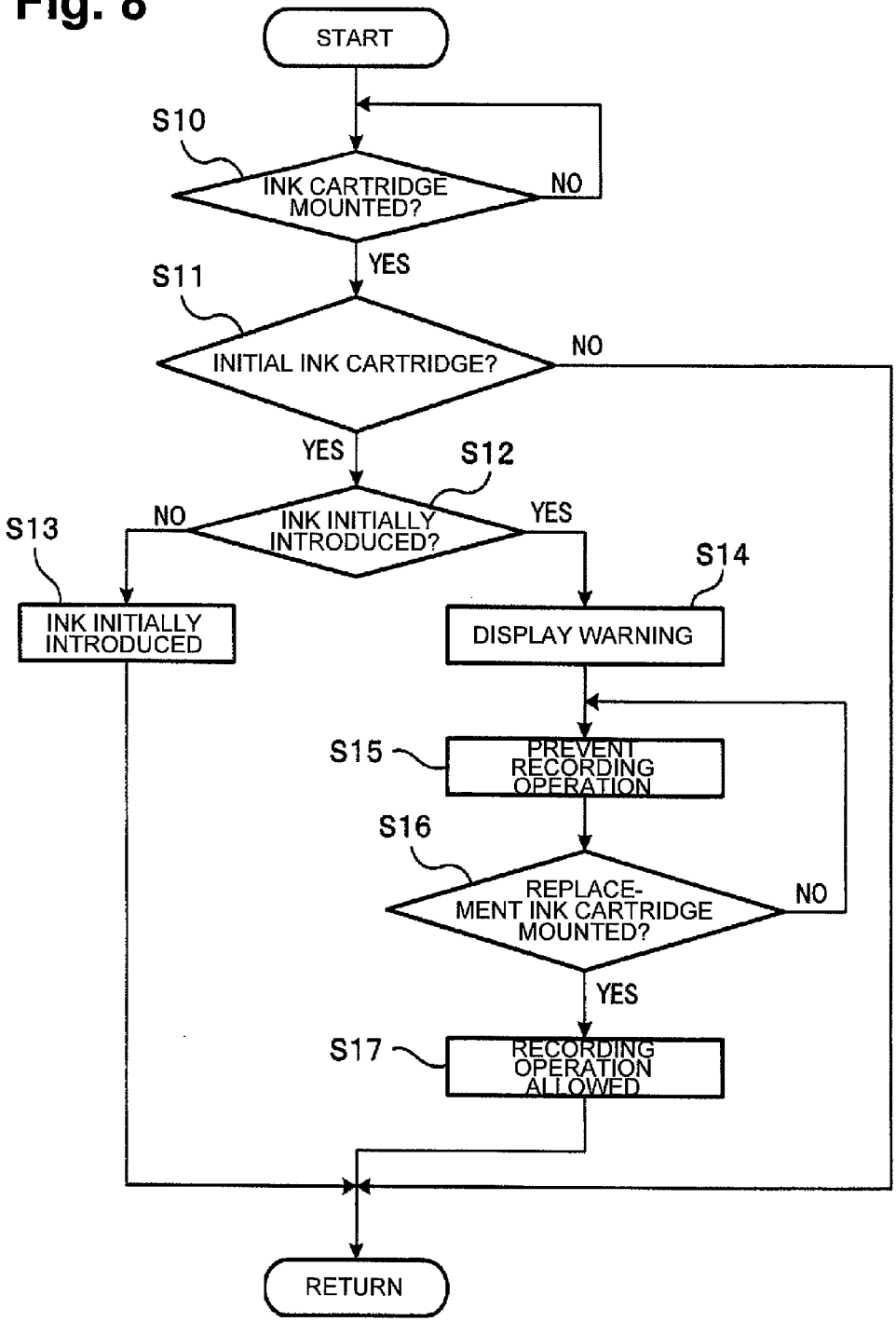
FIG. 8 is a flowchart of processes of determining an ink cartridge type and completion of initial ink introduction to the inkjet head of FIG. 2.

Referring to FIG. 8, processes of determining the type of ink cartridges 6*a* or 6*b* mounted to cartridge mounting portion 24 and completion of the initial ink introduction to inkjet head 3 are described. When cartridge determiner 63 determines, based on an output signal from optical sensor 53, that the mounting action of ink cartridge 6 to cartridge mounting portion 24 has occurred (step S10: YES) and that ink cartridge 6 mounted by the mounting action is replacement ink cartridge 6*b* (step S11: NO), the process may proceed to RETURN and printer 1 may be placed in a condition ready for recording on recording sheets P. When cartridge determiner 63 determines that ink cartridge 6 mounted by the mounting action is initial ink cartridge 6*a* (step S11: YES), initial introduction determiner 65 may determine whether the initial ink introduction to inkjet head 3 is completed, i.e., whether ink has been initially introduced to inkjet head 3, in step S12.

When initial introduction determiner 65 determines in step S12 that the initial ink introduction is not completed i.e., ink has not been initially introduced to inkjet head 3 (step S12: NO), maintenance controller 62 may control maintenance mechanism 7, e.g., suction pump 14, to initially introduce ink to inkjet head 3 in step S13. Thereafter, the process proceeds to RETURN and printer 1 may be placed in a condition ready for recording on recording sheets P. When initial introduction determiner 65 determines that the initial ink introduction is completed, i.e., whether ink has been initially introduced to inkjet head 3 (step S12: YES), which means that the mounting action of initial ink cartridge 6*a* has occurred after ink has been initially introduced to inkjet head 3, controller 8 may cause the display of PC 60 or the display of printer 1 to display a warning that unintended mounting of initial ink cartridge 6*a* to cartridge mounting portion 24 has occurred in step S14. Recording controller 61 may control inkjet head 3 not to perform recording in step S15. Thereafter, when cartridge determiner 63 determines that the mounting action of replacement ink cartridge 6*b* to cartridge mounting portion 24 has occurred (step S16: YES), recording controller 61 may allow inkjet head 3 to perform recording in step S17. Then, the process may proceed to RETURN and printer 1 may be placed in a condition ready for recording on recording sheets P.

The present invention is not limited to the above-described embodiment. Various modifications may be applied. In the above embodiment, as a structure to prevent the use of initial ink cartridge 6*a* unintendedly mounted after the initial ink introduction, inkjet head 3 may be controlled not to perform recording. Nevertheless, other structures may be employed.

Figure 9:
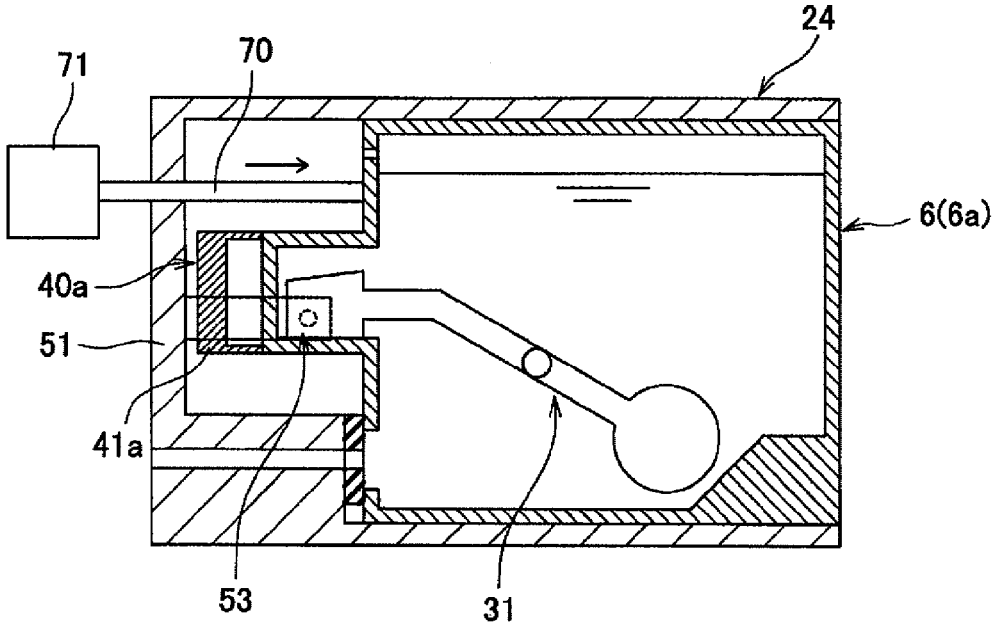
FIG. 9 is a cross-sectional view of a modified holder of the printer of FIG. 1.

For example, referring to FIG. 9, cartridge mounting portion 24 may comprise a bar 70 and a drive portion 71. Bar 70 may passes through front wall 51 of cartridge mounting portion 24. Bar 70 may be configured to move in a front-rear direction of cartridge mounting portion 24, e.g., left-right direction in FIG. 9. Drive portion 71 may comprise a cylinder and a solenoid configured to move bar 70 in the front-rear direction. Controller 90 may be configured to cause drive portion 71 to move bar 70 in the rear direction when the mounting of initial ink cartridge 6*a* to cartridge mounting portion 24 unintendedly occurs after the initial ink introduction. Thus, drive portion 71 may push initial ink cartridge 6*a* out of cartridge mounting portion 24, and thereby initial ink cartridge 6*a* is prevented from being used.

A manner of determining whether ink has been initially introduced to inkjet head 3 may not be limited to the above-described manner. For example, when cartridge determiner 63 once determines that the mounting action of initial ink cartridge 6*a* to cartridge mounting portion 24 has occurred, initial introduction determiner 65 may determine that the initial ink introduction is completed, i.e., determine ink has been initially introduced to inkjet head 3. Thereafter, if initial ink cartridge 6*a* is mounted again, controller 8 may determine that the mounting of initial ink cartridge 6*a* is not intended for the initial ink introduction and determine the unintended mounting of initial ink cartridge 6*a* has occurred.

As a structure to determine the completion of the initial ink introduction in inkjet head 3, i.e., determine whether ink has been initially introduced to inkjet head 3, printer 1 may comprise a sensor, e.g., a laser sensor, configured to directly detect whether ink droplets are ejected from the nozzles. After initial ink cartridge 6*a* is mounted and operations for the initial ink introduction, e.g., suctioning with suction pump 14, are performed, ink droplets may be ejected from inkjet head 3. Completion of the initial ink introduction may be determined by detecting ejection of ink droplets from the nozzles, with the sensor.

In the above embodiment, when the mounting action of initial ink cartridge 6*a* unintendedly occurs after the completion of the initial ink introduction, a warning that unintended mounting of initial ink cartridge 6*a* has occurred may be displayed by the display of PC 60 or the display of printer 1, as shown in step S14 of FIG. 8, and the use of initial ink cartridge 6*a* may be prevented in step S15. Nevertheless, warning may not be given to a user.

In another embodiment, only a warning may be displayed by the display of PC 60 or the display of printer 1 to inform a user of unintended mounting of initial ink cartridge 6*a* but the use of mounted ink cartridge 6*a* may not be prevented.

A structure to give a warning to a user may not be limited to a warning displayed by the display of PC 60 or the display of printer 1. A warming may be given to a user by turning on or blinking a lamp, which may be provided in printer 1 or by issuing beeps or buzzers.

When only warning about unintended mounting of initial ink cartridge 6*a* is given, a user may continue to use initial ink cartridge 6*a*, as long as the user understands any malfunctions may be caused to printer 1. Nevertheless, as described above, when the preset amount of ink used for estimation by residual amount estimator 64 is set to the second initial amount of ink that replacement cartridge 6*b* contains, the first initial amount of ink in initial ink cartridge 6*a* may differ from the preset value if the user decides to continue to use initial ink cartridge 6*a* unintendedly mounted to cartridge mounting portion 24 in spite of the warning. Therefore, the residual ink amount estimated by residual amount estimator 64 may be incorrect and differ from the actual residual amount. When controller 8 determines that the mounting action of ink cartridge 6*a* unintendedly has occurred after the initial ink introduction, and initial ink cartridge 6*a* unintendedly mounted after the initial ink introduction is continuously used, controller 8 may cause the display of PC 60 or printer 1 may to notify, e.g., display a message, that the estimated residual ink amount displayed by the display based on the estimation by residual amount estimator 64 may be incorrect. Even when incorrect residual ink amount estimation is displayed, it may be notified that displayed estimation may be incorrect. This may reduce chances that a user believes the displayed incorrect residual amount.

In the above embodiment, whether the mounting action of ink cartridge 6 has occurred and the type of mounted ink cartridge 6 are determined based on output signals from one optical sensor 53. Nevertheless, whether the mounting action of ink cartridge 6 has occurred and the type of mounted ink cartridge 6 may be determined using separate sensors.

A sensor used for determining whether the mounting action of ink cartridge 6 has occurred and determining the type of mounted ink cartridge 6 may not be limited to optical sensor 53. For example, electrical contact may be provided to each of cartridge mounting portion 24 and ink cartridge 6. Mounting of ink cartridge 6 to cartridge mounting portion 24 may be determined by detecting continuity between the electrical contacts of cartridge mounting portion 24 and ink cartridge 6 when ink cartridge 6 is mounted to cartridge mounting portion 24. In another embodiment, a proximity sensor or contact-type sensor may be used.

According to the above embodiments and modifications, the invention may be applied to inkjet printers configured to form, e.g., an image by ejecting ink droplets onto recording sheets P. Nevertheless, applications of the invention may not be limited to the inkjet printers. The invention may be applied to liquid ejection devices that may be employed in various technical fields.

While the invention has been described in connection with various example structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A liquid ejection device, comprising:

a liquid ejection head configured to eject liquid;

a cartridge mounting portion configured to removably mount thereon a liquid cartridge configured to contain liquid therein, and configured to supply liquid from the liquid cartridge mounted on the cartridge mounting portion to the liquid ejection head, wherein the cartridge mounting portion is configured to selectively mount an initial-type liquid cartridge that contains a first initial amount of liquid, a partial amount of which is to be initially introduced to the liquid ejection head before the liquid ejection device is initially used, and a replacement-type liquid cartridge that contains a second initial amount of liquid, wherein the second initial amount is less than the first initial amount; and a controller configured to perform:

a cartridge mounting determination in which it is determined whether a mounting action of the liquid cartridge to the cartridge mounting portion has occurred;

a cartridge type determination in which it is determined whether the liquid cartridge mounted by the mounting action is the initial-type liquid cartridge or the replacement-type liquid cartridge; and an initial introduction determination in which it is determined whether liquid has been initially introduced to the liquid ejection head;

wherein when the controller determines that the mounting action has occurred and the liquid cartridge mounted by the mounting action is the initial-type liquid cartridge after liquid has been initially introduced to the liquid ejection head, the controller prevents the initial-type liquid cartridge from being used or gives warning.

2. The liquid ejection device according to claim 1, wherein when the controller determines that the liquid cartridge mounted by the mounting action is the replacement-type liquid cartridge, the controller is configured to perform a residual amount estimation in which a residual amount of liquid in the liquid cartridge mounted on the cartridge mounting portion is estimated, based on a preset amount of liquid which corresponds to the second initial amount of liquid and an amount of liquid consumed by the liquid ejection head.

3. The liquid ejection device according to claim 2, wherein the controller is configured to send information on an estimated residual amount of liquid to a display configured to display, based on the information, the residual amount of liquid in the liquid cartridge mounted on the cartridge mounting portion, and the controller is configured to cause the display to notify that the residual amount displayed by the display based on the information is incorrect when the controller determines that the mounting action has occurred and the liquid cartridge mounted by the mounting action is the initial-type liquid cartridge after liquid has been initially introduced to the liquid ejection head.

* * * * *